US005152245A

United States Patent [19]

Olsen

[11] Patent Number: 5,152,245

[45] Date of Patent: Oct. 6, 1992

[54] FLOATABLE LADDER DEVICE

[76] Inventor: Roy Olsen, P.O. Box 21, Seal Beach, Calif. 90740

[21] Appl. No.: 569,201

[22] Filed: Aug. 20, 1990

[51] Int. Cl.[5] ..... B63B 17/00

[52] U.S. Cl. ..... 114/362; 182/151; 441/39

[58] Field of Search ..... 114/219, 362, 357, 294; 441/39, 81, 125-127, 129, 80; 182/104, 151, 228

[56] References Cited

U.S. PATENT DOCUMENTS

| | | | |
|---|---|---|---|
| 3,842,776 | 10/1974 | Wudtke | 114/294 |
| 4,014,057 | 3/1977 | Kuojarvi | 114/362 |
| 4,457,729 | 7/1984 | Peerlkamp | 114/357 |

FOREIGN PATENT DOCUMENTS

| | | | |
|---|---|---|---|
| 0178773 | 4/1986 | European Pat. Off. | 114/362 |
| 2527247 | 7/1976 | Fed. Rep. of Germany | 114/362 |

*Primary Examiner*—Sherman Basinger
*Attorney, Agent, or Firm*—John E. Halamka

[57] ABSTRACT

A floatable device having a ridged body containing a plurality of tie points near the edge and a substantially central orifice. Several bodies may be tied in series to form a ladder for ingress and egress of boats. The body may be filled with closed cell foam to sustain buoyancy if the ridged body is pierced or cracked. The body may be tinted a bright, safety color. The ties securing the blocks together may be whipped with a clamp having a tapered end to prevent the knots from slipping.

8 Claims, 2 Drawing Sheets

Fig. 1.
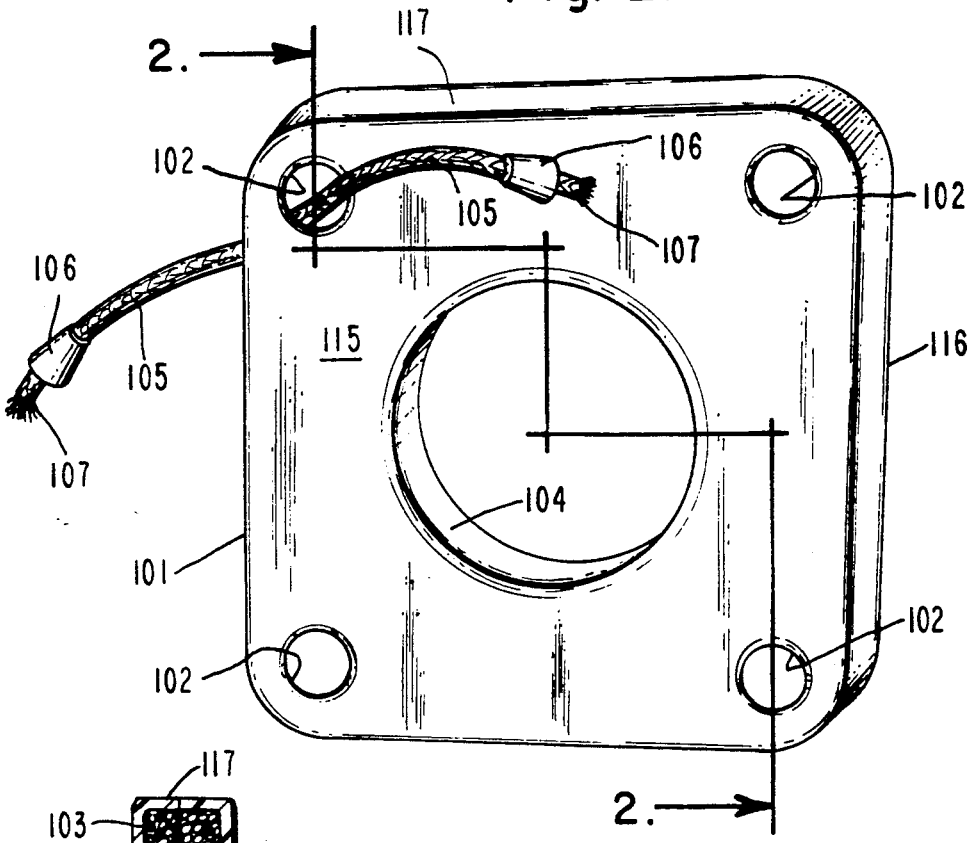
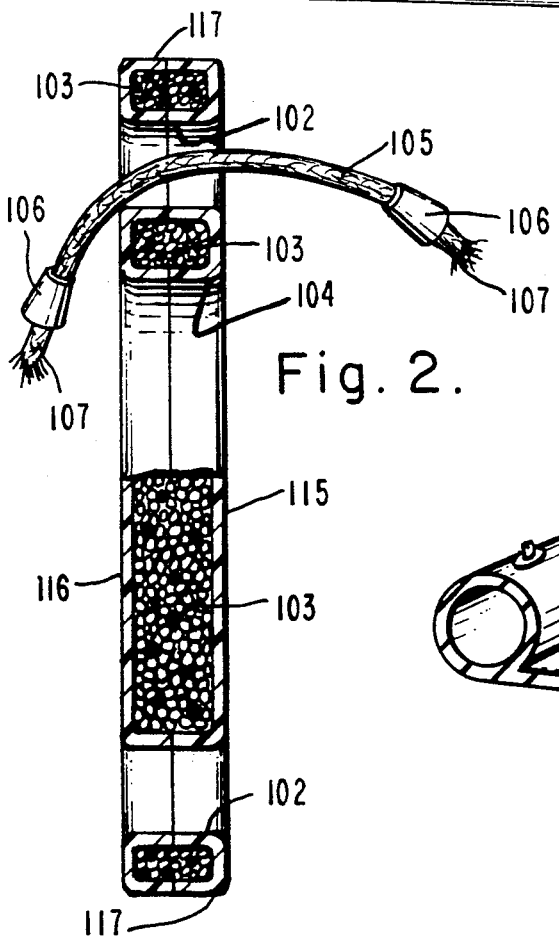
Fig. 2.
Fig. 5.
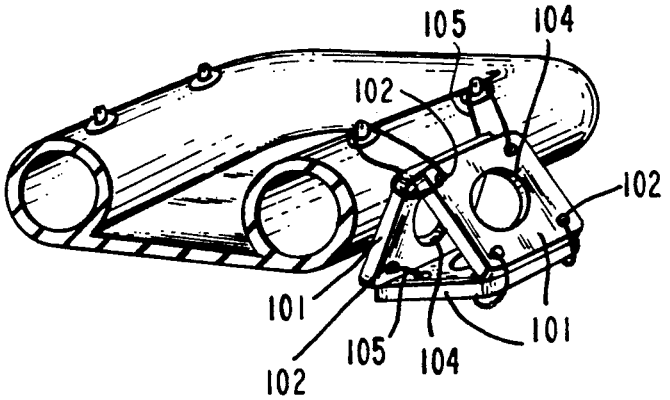

FLOATABLE LADDER DEVICE

BACKGROUND OF THE INVENTION

1. Field of the Invention

The present invention relates to a device which aids the user in the ingress and egress from objects which may be moving, especially on the surface of a body of water, and, more particularly, to a safety device which may be used as a ladder and as a flotation device.

2. Description of the Prior Art

Boats have generally been difficult to board by a person immersed in the water by the side of the boat. Several devices have been employed. One such is a tethered life saver float. The device may be thrown near the person to grab and hang onto while being hauled near the side of the boat. However, this device does not aid in helping the person out of the water and onto the boat. The person in the water may hold onto the device but the person on board has the arduous task of hauling the person and the device on board by pulling up on the tether, a very difficult task. Even if the person on board ties off the tether, the person in the water must lift himself out of the water by climbing up the smooth, wet, and usually thin rope.

Several types of platforms and ladders have been employed for this final stage. Some ladders are solid and hang or are fixed to the side of the boat. A platform may also be fixed to the outside of the boat to assist a person with scuba gear to lift up out of the water and then climb into the boat. However, these devices appear as cheese cutters to a person in the water if even moderate wave action is causing the boat to heave.

Other soft devices such as a rope ladder have been used to overcome the threat of injury from a flaying solid ladder. These rope ladders have proven to be difficult to use and introduce their own safety hazard to the user. The flexibility of the rope ladder allows it to conform to the side of the boat, which when used results in the pressing of the horizontal steps up against the boat making it difficult or impossible to obtain a secure hand and foot hold. Further, the lateral instability of the rope ladder makes it difficult to use, especially for a tired or panic stricken victim.

Several devices such as U.S. Pat. No. 65,901 and U.S. Pat. No. 1,263,824 teach life saving rafts which may be assembled, and thrown overboard to assist a victim. However, as with the life saver, once the device and victim are broadside, the solution of the problem of assisting the victim from the water onto the boat is not solved.

Thus, there has long been a need for an arrangement to assist a person in safely boarding a boat from the water.

It is desired that this device be easy to store, easy to use at a moments notice.

It is further desired that the device not itself present a safety hazard to the user.

It is yet further desired that the device, when attached to the outside of the boat and used as a ladder, not conform to the side of the boat so that the device allows usable hand and foot holds.

It is yet another desire that the device provide lateral stability yet be assembled from elements which withstand the riggers of the elements present on board a boat.

SUMMARY OF THE INVENTION

Accordingly, it is a object of the present invention to provide an improved safety flotation device which may be used to bring a person near the boat, be tied off and used as a ladder by the person for easy and safe ingress to the boat.

It is another object of the present invention to provide an arrangement which is easy to store out of the way yet is immediately available for use.

Is yet another object of the present invention to provide a ladder arrangement on the side of the boat assembled from elements which withstand the corrosive elements of sun and sea yet which does not present a safety hazard to the person in the water should the boat be heaving.

It is yet another object of the present invention to provide a ladder arrangement which has lateral stability and does not press up against the side of the boat when in use. The present invention provides sufficient, safe hand and foot holds for easy ingress or egress from the boat even by a tired or panic stricken user.

The above and other objects of the present invention are achieved, according to a preferred embodiment thereof, by providing an apparatus formed by attaching a number of individual flotation blocks together to form a ladder. Usually three such blocks will form a path between the water surface and the rail of the boat.

Each individual flotation block is formed of a hollow molded, high impact plastic body of material such as polythene or urea-formaldehyde resin. Ultra-violet inhibitor should be added to the selected plastic to improve the life of the device in harsh weather conditions. The material in the preferred embodiment is dyed a bright, safety yellow color. The body in the preferred embodiment is shaped as a square approximately 14" on the side and approximately 1" thick. Each block is formed with a plurality of holes. A hole approximately $1\frac{1}{2}$" in diameter is formed near each corner and used as tie points. A hole approximately 7 to 8 inches in diameter is formed in the center of the block and used as a hand/foot hold.

Of course other geometrical shapes such as a rectangle, as shown in FIG. 6, may be used for the shape of the body.

Ties may be used to fasten the blocks together. In the preferred embodiment, the ties are made of nylon braided dockline, approximately 22" long and finished on each end with a molded clamp to whip each bitter end. Nylon dockline of a diameter of $\frac{3}{8}$" is selected for the preferred embodiment as such a cord may have tensile strength of up to 4,200 pounds. Further, the color of the nylon will not fade nor will it rot or mildew.

The molded clamp is formed of plastic and may be tapered from the edge of the clamp next to the end toward the center of the tie. Therefore, when tied, any slippage of the end of the tie back through a knot will be prevented by such tapered surface.

A first tie is threaded through one tie point in one block and a tie point in an adjacent block. A square knot or two half-hitches may be used to fasten the ends of the tie together. A second tie is threaded through another tie point which is adjacent another tie point in the adjacent block and tied.

This process is continued until the user has assembled the preselected number of flotation blocks into the desired configuration.

The desired configuration may be a simple series of three blocks or a pair of such series in parallel to form a three by two block rectangle. This configuration has additional lateral stability because it allows the user to place his feet in horizontally adjacent steps rather that vertically adjacent steps.

Each body may be formed as a sealed, hollow unit. The air captured inside will give each block buoyancy. This buoyancy is lost upon any puncture or damage to the integrity of the body.

In the preferred embodiment, the hollow body is filled by being injected with closed cell foam. The density of the foam should not outweigh the buoyancy contained in the foam cells. The closed cell foam used in the preferred embodiment is urethane. Should the body become pierced or cracked, the closed cell foam will retain the majority of the buoyancy of the flotation block.

BRIEF DESCRIPTION OF THE DRAWINGS

The above and other embodiments of the present invention may be more fully understood from the following detailed description, taken together with the accompanying drawing, wherein similar reference characters refer to similar elements throughout, and in which:

FIG. 1 is an elevational view of one block of the present invention;

FIG. 2 is a cross-sectional view taken along line 2—2 of FIG. 1;

FIG. 5 is a perspective view of a configuration of blocks mounted on a life raft; and, FIG. 6 is a perspective view of an embodiment of the device.

DESCRIPTION OF A PREFERRED EMBODIMENT

Figure 3:
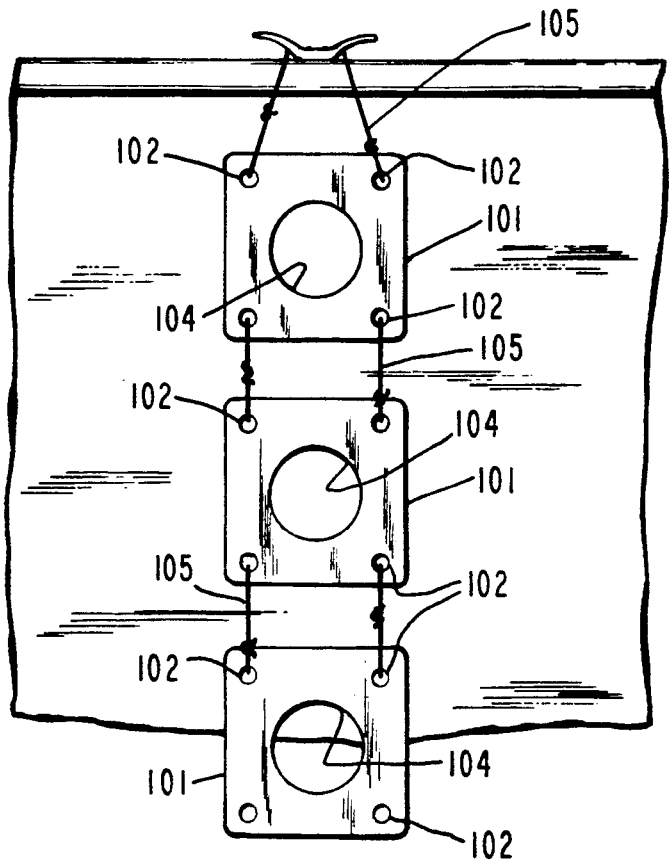
FIG. 3 is side view of blocks tied together, fastened to a cleat on a boat and hung over the side into the water.

Referring now to the drawing, FIG. 1 shows one flotation block 10 unitarily molded of a high impact, ridged plastic such as polythene into a hollow body 101. In the preferred embodiment, the block 10 is shaped as a square with sides approximately 14 inches long and approximately 1 to 1½ inch thick.

The front surface 115 of the block 10 and the back surface 116 are essentially coextensive. A peripheral edge 117 of a preselected width joins the outside edges of the front surface 115 and back surface 116. The peripheral edge 117 is shaped so that the corners and edges of the block 10 are rounded to remove sharp edges and points which may injure the user.

A plurality of first walls form tie points 102 near each corner of the block. The walls are curved into a convex surface as they meet the outside surfaces of the block 10 to form a smooth, double curved transition which will not chaff the ties 105 which hold adjacent blocks together.

A second wall forming a central aperture in the block provides a step 104. This step 104 also serves as a handhold. This second wall is also curved into a convex surface as it meets the outside surfaces of the block 10 to form a smooth, double curved transition and eliminates any sharp edges which would be uncomfortable to bare hands and feet. In the preferred embodiment, the diameter of the central aperture is 7⅜ inches so that a dive bottle may be mounted through this center aperture of a plurality of blocks 10 and secured to the blocks 10. Dive bottles have near neutral buoyancy so that one to three blocks will keep the dive bottle afloat on the surface of the water for convenient access by a diver.

The thickness of the block 10 in the preferred embodiment is 1 to 1½ inches so that the step 104 ergonomically fits the hand as a hand hold and the arm as a catch yet provides enough surface to be a comfortable step for even a bare foot.

The buoyancy of the block 10 may be preserved should the body 101 be punctured or cracked by filling the hollow body 101 with closed cell foam 103. The material selected should be Coast Guard Approved. In the preferred embodiment, approximately ⅓ lb. of urethane is blown into the hollow body 101. The urethane may be inserted in a liquid form to flow into all spaces inside of the body 101. The foam sets up into a solid form within a very short time. This type of process is well known in the art such as providing shape conforming packaging for shipment of delicate instruments and electronics.

When the block 10 is used as a float by itself or attached to a tether for rescue, the block 10 does not sail in the wind but allows the user to throw the device near the victim without the chance of the block 10 being swept away by the wind or waves.

If the block 10 is on a tether when thrown, the victim may grab the handhold or insert an arm through the step 104. The user may then pull the victim near the boat. A preselected configuration of blocks 10 may be attached to the side of the boat to allow the victim access to the boat.

One such configuration is three blocks 10 in a series as shown in FIG. 3.

The ties 105 may be used to attach the blocks 10 together at the tie points 102.

Clamps 106 may be mounted on each of the ends of the ties 105 to whip the bitter ends. The clamps 106 may be formed with a conical surface tapering from the end toward the center of the tie. After the tie 105 is knotted, the clamp 106 will act as a stop to prevent the end of the tie from pulling through the knot.

A longer tie 105 may be used to attach the series of blocks 10 to the boat at a convenient cleat. This end tie may utilize quick attachment devices such as a tee bracket with a short staff the end of which is secured to the tie 105. The tee may have a long cross member so that the tee and tie 105 will slip through the tie point 102 sideways but when rotated ninety degrees cannot be pulled back through because of the long cross member.

Because the block 10 is long and rigid and contains an integrated step, the force of the user on the step 104 tends to make the block 10 tilt away from the side of the boat unlike a rope ladder which is forced into the side of the boat. Thus the user can climb up and out of the water without having hand or foot crushed against the boat.

If boat side is convex downward, such as a submarine, this device will still out-perform a rope ladder in that the thickness of the rigid blocks 10 act as a stand-off to allow finger and toe holds on the steps 104.

Certain boat configurations such as the flat bottom whaler and rubber raft present unique boarding problems. Although each have low rails, the access may still be difficult.

Figure 4:
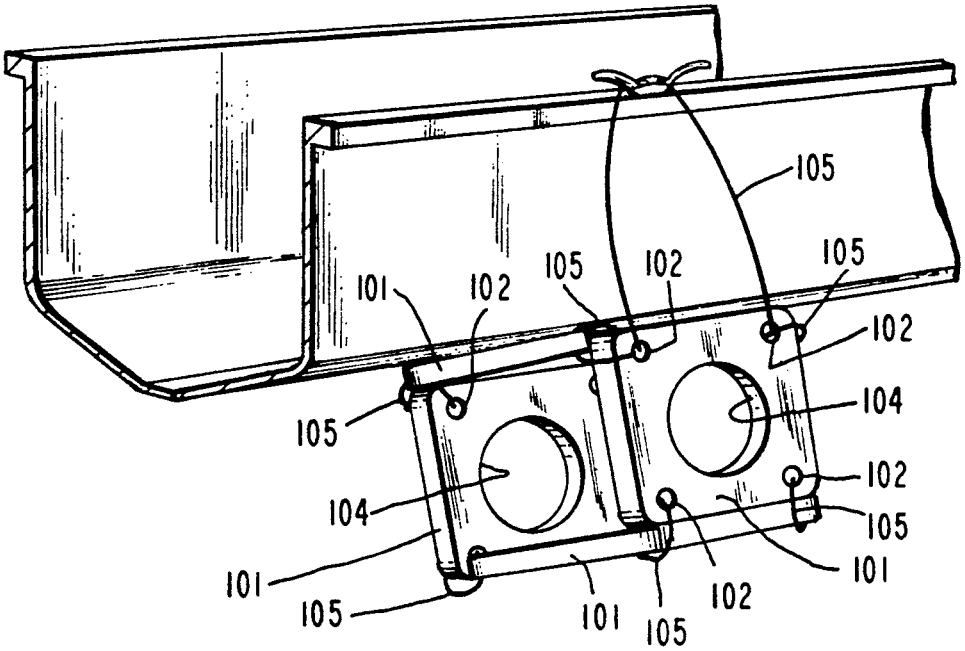
FIG. 4 is a side view of a configuration of blocks mounted on a boat.

FIG. 4 shows a configuration of blocks 10 which may be used to ease access to a ridged, short sided, flat bottom boat.

FIG. 5 shows a configuration of blocks 10 which may be used to ease access to a soft sided rubber raft.

The color used in the preferred embodiment is a bright safety yellow. Other colors such as safety orange may be utilized. A block 10 or series of blocks 10 when used as a float will greatly enhance the visibility of a victim in the water.

The preferred embodiment is shaped essentially as a square with flat sides. The sides may be alternately concave and convex so that the blocks 10 nest. The configurations may be mounted so that the concave side is next to the boat to form an integral stand-off of the step 104 from the side of the boat.

The orifice forming the tie points 102 and the steps 104 may be of selected geometrical shapes. The preferred embodiment shows the shapes to be circular. The shapes may well be selected to be square, rectangular or triangular and perform the same function.

The blocks 10 may be formed in different geometrical shapes such as a triangle or rectangle as shown in FIG. 6. The rectangle may contain a plurality of steps 104.

Since certain change may be made in the above apparatus without departing from the scope of the invention herein involved, it is intended that all matter contained in the above description, as shown in the accompanying drawing, shall be interpreted in an illustrative, and not a limiting sense.

What is claimed is:

1. An improved floatable ladder arrangement for mounting on a boat, and comprising, in combination:

a unitarily fabricated, rigid, body having a front surface, a back surface substantially coextensive with said front surface, and a peripheral edge defining the boundaries of said front and back surface;

said front and back surface defining a preselected geometric surface, having a center line, and free of sharp edge portions;

said peripheral edge having a preselected width and defining a smooth transition with said front and back surface thereby enclosing a hollow space;

a plurality of first walls mounted between said front and back surface at preselected locations near the upper and lower, right and left edges of said geometric surface defining a plurality of tie point orifices remote from said center line of said body;

said first walls having substantially the same width as said peripheral edge and defining a smooth transition with said front and back surface;

a second wall mounted between said front and back surface substantially in the center portion of said geometric surface defining a step orifice of a preselected size;

said second wall having substantially the same width as said peripheral edge and defining a smooth transition with said front and back surface; and, a plurality of ties mounted through said tie points of adjacent bodies to form a plurality of connected bodies in a predetermined, latterly stable, configuration whereby a user may tie one end of said configuration to the boat and hang the other end of said configuration over the side of the boat thereby providing a pathway for ingress/egress from the boat to the water.

2. An improved floatable ladder arrangement defined in claim 1 wherein said body is air tight.

3. An improved floatable ladder arrangement defined in claim 1 further comprising:

closed cell foam mounted within said body to fill the hollow space between said front side and said back side.

4. An improved floatable ladder arrangement defined in claim 1 wherein said geometric surface is a square.

5. An improved floatable ladder arrangement defined in claim 1 wherein said geometric surface is a rectangle.

6. An improved floatable ladder arrangement defined in claim 1 further comprising:

a preselected color tint added to the material used to unitarily fabricate said rigid body.

7. An improved floatable ladder arrangement for mounting on a boat, and comprising, in combination:

a unitarily fabricated, rigid, body having a front surface, a back surface substantially coextensive with said front surface, and a peripheral edge defining the boundaries of said front and back surface;

said front and back surface defining a preselected geometric surface, having a center line, and free of sharp edge portions;

said peripheral edge having a preselected width and defining a smooth transition with said front and back surface thereby enclosing a hollow space;

a plurality of first walls mounted between said front and back surface at preselected locations near the upper and lower, right and left edges of said geometric surface defining a plurality of tie point orifices remote from said center line of said body;

said first walls having substantially the same width as said peripheral edge and defining a smooth transition with said front and back surface;

a second wall mounted between said front and back surface substantially in the center portion of said geometric surface defining a step orifice of a preselected size;

said second wall having substantially the same width as said peripheral edge and defining a smooth transition with said front and back surface;

a plurality of ties mounted through said tie points of adjacent bodies to form a plurality of connected bodies in a predetermined, latterly stable, configuration whereby a user may tie one end of said configuration to the boat and hang the other end of said configuration over the side of the boat thereby providing a pathway for ingress/egress from the boat to the water; and, a molded clamp mounted on each end of each of said plurality of ties to whip each bitter end.

8. An improved floatable ladder arrangement for mounting on a boat, and comprising, in combination:

a unitarily fabricated, rigid, body having a front surface, a back surface substantially coextensive with said front surface, and a peripheral edge defining the boundaries of said front and back surface;

said front and back surface defining a preselected geometric surface, having a center line, and free of sharp edge portions;

said peripheral edge having a preselected width and defining a smooth transition with said front and back surface thereby enclosing a hollow space;

a plurality of first walls mounted between said front and back surface at preselected locations near the upper and lower, right and left edges of said geometric surface defining a plurality of tie point orifices remote from said center line of said body;

said first walls having substantially the same width as said peripheral edge and defining a smooth transition with said front and back surface;

a second wall mounted between said front and back surface substantially in the center portion of said geometric surface defining a step orifice of a preselected size;

said second wall having substantially the same width as said peripheral edge and defining a smooth transition with said front and back surface;

a plurality of ties mounted through said tie points of adjacent bodies to form a plurality of connected bodies in a predetermined, latterly stable, configuration whereby a user may tie one end of said configuration to the boat and hang the other end of said configuration over the side of the boat thereby providing a pathway for ingress/egress from the boat to the water; and, a molded clamp mounted on each end of each of said plurality of ties to whip each bitter end wherein said molded clamp contains a conical surface tapering from said bitter end towards the center of said tie.

* * * * *